United States Patent [19]

Stieber

[11] Patent Number: 4,737,647

[45] Date of Patent: Apr. 12, 1988

[54] TARGET ASSEMBLY FOR AN ELECTRON LINEAR ACCELERATOR

[75] Inventor: Volker Stieber, Walnut Creek, Calif.

[73] Assignee: Siemens Medical Laboratories, Inc., Walnut Creek, Calif.

[21] Appl. No.: 846,642

[22] Filed: Mar. 31, 1986

[51] Int. Cl.[4] ..... H05G 3/00

[52] U.S. Cl. ..... 250/505.1; 250/492.1; 378/143

[58] Field of Search ..... 250/491.1, 492.1, 492.3, 250/493.1, 503.1, 505.1, 526; 378/143; 313/363.1

[56] References Cited

U.S. PATENT DOCUMENTS

| | | | |
|---|---|---|---|
| 3,287,592 | 11/1966 | Hirschfield et al. | 378/143 |
| 3,525,228 | 8/1970 | Anderson | 378/143 |
| 3,660,664 | 5/1972 | Pasmeg | 250/505.1 |
| 3,755,672 | 8/1973 | Edholm et al. | 250/332 |
| 4,095,114 | 6/1978 | Taumann | 250/510 |
| 4,121,109 | 10/1978 | Taumann et al. | 250/505 |
| 4,323,780 | 4/1982 | Tombaugh et al. | 250/419 |
| 4,481,419 | 11/1984 | Persyk | 250/363 S |

FOREIGN PATENT DOCUMENTS

| | | | |
|---|---|---|---|
| 0149571 | 7/1985 | European Pat. Off. . | |
| 1401374 | 4/1965 | France | 250/492.1 |

*Primary Examiner*—Bruce C. Anderson
*Assistant Examiner*—Paul A. Guss
*Attorney, Agent, or Firm*—Mark H. Jay

[57] ABSTRACT

A target assembly for an electron linear accelerator (LINAC), comprising a target for converting electron beams of different energies into x-ray beams. The target has a variable thickness which can be set to a predetermined value by adjustment means. In a preferred embodiment, the target is provided with a chamber defined by two parallel plates and a bellows connecting both plates. The chamber is filled with a liquid medium of a high atomic number, such as mercury. In operation the medium is pumped through the chamber, and cooled down in a heat exchanger.

13 Claims, 2 Drawing Sheets

TARGET ASSEMBLY FOR AN ELECTRON LINEAR ACCELERATOR

BACKGROUND OF THE INVENTION

The invention relates to a target assembly for an electron linear accelerator (LINAC). In particular, it relates to a target for a LINAC capable of supplying x-ray beams of different energies.

A LINAC supplies x-rays by directing an electron beam onto a target, where the decelerated electrons emit the desired x-ray quanta. Such a target must endure high thermal stresses for a long period of time; in a typical example 300 to 500 watts are created within a target area of 1 to 2 mm diameter for 40 minutes.

A target assembly with an improved cooling capacity is described in U.S. Pat. No. 4,323,780. In this arrangement, the target is suspended in a recess of a solid metal plate. The target divides the recess into an upper and lower chamber, each being part of a channel. In an operation, a liquid coolant is directed through the channels so that the target is at both sides directly exposed to a streaming medium. Such a system is relatively complicated; moreover, its beam conversion capability is impaired by the fact that electrons and photons must pass through additional layers of ray-absorbing and dispersing material.

Further problems arise, if a LINAC is required to supply x-ray beams with a variety of beam energies: an optium ratio between beam power and beam quantity, i.e. angular intensity distribution and energy spread, is obtained when the target is about one-fifth of the electron penetration range in thickness (see, e.g. Electro Medica, 3–4 (1977) 101, section "Roentgenbremsstrahlung"). When the target thickness exceeds this value, the beam power increases somewhat but the angular intensity distribution degrades significantly and the energy profile is broadened by low energy components. Thus, the target (which usually consists of a heavy metal like tungsten or gold) can only be optimized for one $e^-$beam energy. To obtain optimum results at other energy levels as well, the accelerator may be operated with selected ones of a set of targets, each adjusted to a certain energy level. In the published European patent application 149571, there is taught to arrange different targets on a common support, which may be a slidable plate or a rotatable disc and may be moved together with, or independent of, the flattening filter. All these structures are elaborate—the targets must be positioned very carefully—and can conduct heat away from the target only to a limited degree.

An object of the invention is to provide a LINAC target assembly which allows different tradeoffs between beam power and quality.

A more specific object is to provide a LINAC target allowing a favorable optimum ratio between beam power and quality for different electron beam energies.

A further object is to provide a simple LINAC target assembly capable of dissipating the heat due to energy losses.

Still another object is to improve on the LINAC target assemblies in the art.

SUMMARY OF THE INVENTION

In accordance with the invention, a target assembly has a target for converting and electron beam into a x-ray beam, said target having a variable thickness.

Adjustment means are provided for setting the target thickness.

In a preferred embodiment, the target has a chamber which is defined by two parallel plates and a bellows connecting both plates. The chamber is filled with a liquid heavy metal such as mercury. In operation, the liquid is pumped through the chamber and cooled in a heat exchanger. The target thickness is controlled by two motor-driven spindles projecting through both plates.

The foregoing and other objects, features and advantages of the invention will be apparent from the following more particular description of a preferred embodiment of the invention, as illustrated in the accompanying drawings.

BRIEF DESCRIPTION OF THE DRAWINGS

Throughout the drawings, like elements are referred to by like numerals.

DESCRIPTION OF A PREFERRED EMBODIMENT

Figure 1:
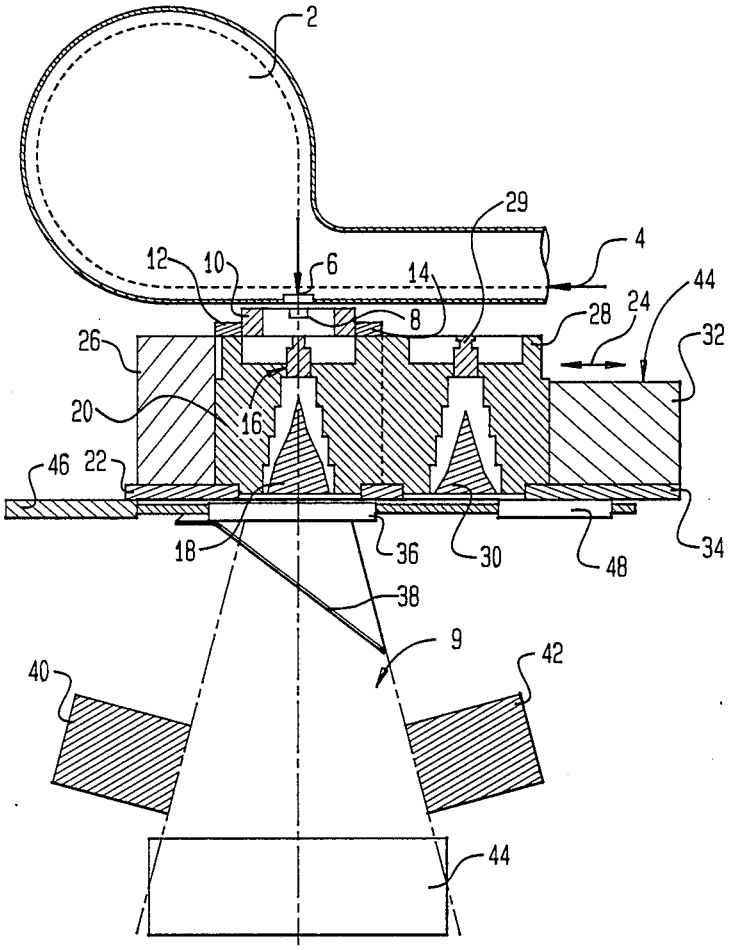
FIG. 1 is a simplified cross-section of a LINAC beam-defining system comprising a target assembly according to the invention.

In FIG. 1, there is shown a versatile electron linear accelerator capable of supplying electron and x-ray beams of different energies. The LINAC is provided with a magnet system 2 which deflects an entering electron beam 4 and sends the bended beam through an exit window 6 onto a target assembly symbolized for simplicity by a block 8. Target assembly 8 is mounted on a first slide 10 which can be moved in a direction perpendicular to the drawing plane along guide rails 12, 14. Slide 10 also carries a primary scattering foil (not shown).

Target assembly 8 produces an x-ray beam 9 which passes through an electron absorber 16 and a first flattening filter 18. Absorber 16 and filter 18 are inserted in a passage way of a first collimator 20. Filter 18 and collimator 20 are mounted on a filter carriage 22 which is slidable along a direction indicated by arrows 24. Filter carriage 22 also carries a shielding block 26, a second collimator 28, a second electron absorber 29 and a second flattening filter 30 positioned in a passsage way of collimator 28. Collimator 28 abutts at a stopping block 32 which is carried by a stop carriage 34 slidable along the direction of arrows 24.

After passing through first flattening filter 18 the x-rays penetrate consecutively an x-ray dose chamber 36, a light field mirror 38 and an x-ray shielding jaws system comprising four jaws, three thereof being shown and designated with the numerals 40, 42 and 44. Dose chamber 36 and light field mirror 38, whose associated light source is not shown, are mounted on a second slide 46. Slide 46, which is slidable along a direction marked by arrows 24, supports a second scattering foil 48. The jaw system serves to define, together with the passage of collimator 12 or 28, the boundaries of x-ray beam 9.

Figure 2:
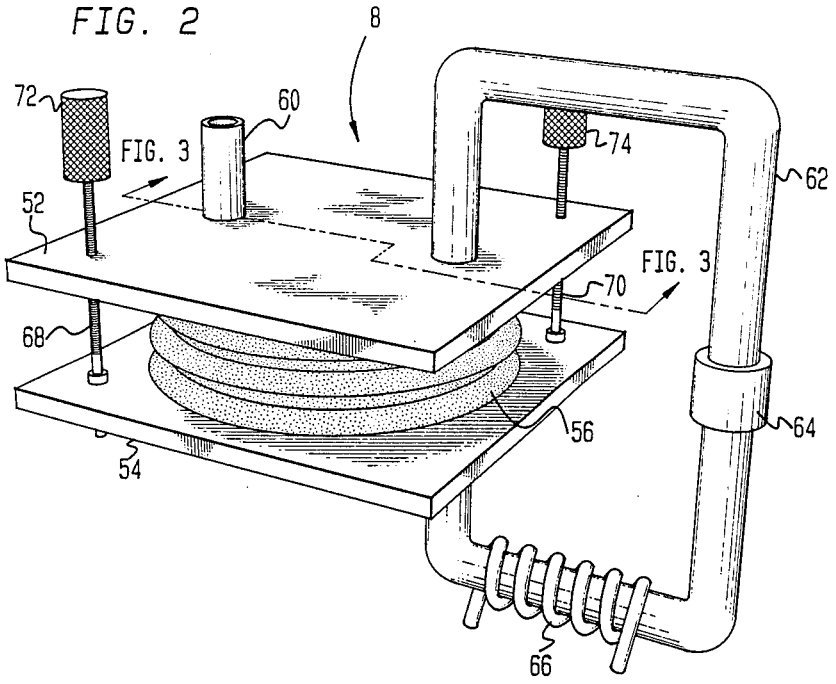
FIG. 2 is a perspective view of the target assembly of FIG. 1, shown in more detail.
Figure 3:
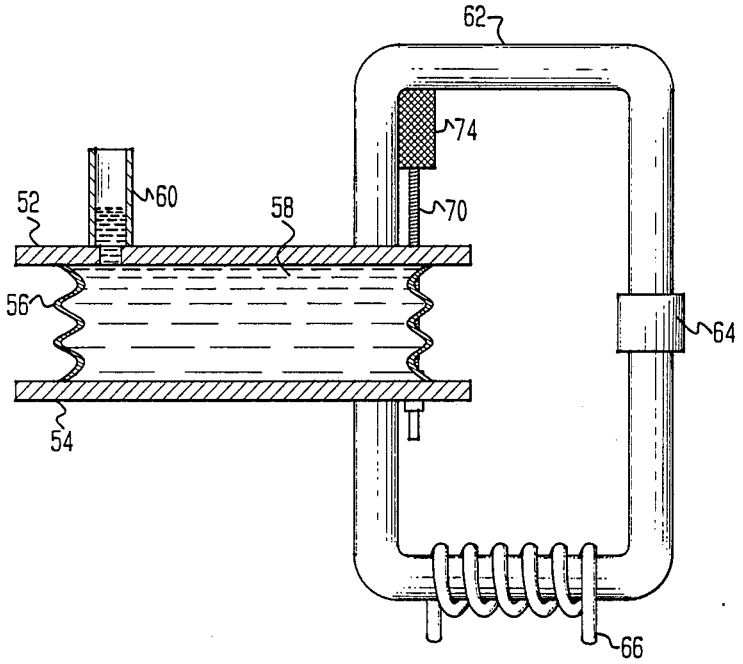
FIG. 3 is a cross-section of FIG. 2, along lines III—III.

FIGS. 2 and 3 show the target assembly of FIG. 1 in more detail. The assembly may be fastened to slide 10 in a conventional manner, for example with screws. This atachment is not part of the present invention and therefore not shown. The actual target consists of two parallel plates 52, 54 and a bellows 56 connecting both plates. All three parts, which may consist of stainless steel, define a chamber 58. This chamber is connected with a compensation tank 60 on top of plate 52 and filled with a suitable target liquid. Advantageously, this liquid has a high atomic number, for in this case the emitted x-ray beam has a relatively broad angular distribution so that filter alignment requirements are less stringent. Mercury is a well suited medium, but there are also other possible candidates which are liquid at least when bombarded by the electron beam, for example lead or alloys containing mercury, lead, zinc and/or antimon like Wood's alloy.

Target assembly 8 further contains a pipe 62 both ends thereof being fastened to plates 52 and 54 respectively. Via plate holes (not shown), pipe 62 is in communicative connection with chamber 58 so that a closed circuit is established for the fluid target medium. To circulate the medium a pump 64 is inserted into pipe 62, and for abstracting heat from the medium a coil 66, which may be made from copper and contain water, is tightly wound around pipe 62.

For varying the distance between plates 52 and 54 and thus the thickness of the mercury layer, there are provided two threaded spindles 68, 70 projecting through both plates at opposite corners and rotatable by servo-motors 72, 74. By synchronously rotating spindles 68, 70 plate 52 is moved in a direction perpendicular to its extension plane while plate 54, which may be attached to slide 10, keeps its position. This way the target is always well aligned.

To obtain the optimum ratio between beam power and quality the composite layer of plates 52, 54 and mercury has a thickness of $0.2\times d_O$ ($d_O$=electron penetration depth) which depends upon the electron energy and the density of the target material. The plates are usually fairly thin and of relatively low atomatic number, so that the optimum target thickness is obtained with a plate distance only slightly less than $0.2\times d_O^{Hg}$ ($d_O^{Hg}$=electron penetration depth in mercury).

The LINAC operates in three modes: a high energy photon mode (20 MV), a low energy photon mode (6 MV) and an electron mode. In the high energy photon mode, the arrangement within the beam defining system is as shown in FIG. 1, i.e. the $e^-$beam hits the target, and the x-rays emitted therefrom penetrate first flattening filter 18, x-ray dose chamber 36 and light field mirror 38. The target is adjusted such that the mercury layer is 2.5 mm in thickness. In the low energy photon mode, slide 22 is shifted to the left so that the x-ray beam penetrates second electron absorber 29 and second flattening filter 30. The thickness of the mercury layer is adjusted to 0.75 mm. In the electron mode slides 10 and 46 as well as carriages 22 and 34 are moved so that the $e^-$beam hits the first scattering foil, travels through a beam limiting passage way defined by collimator 28 and stopping block 32 and impinges on second scattering foil 48.

Having thus described the invention with particular reference to the preferred forms thereof, it will be obvious to those skilled in the art to which the invention pertains, after having understood the invention, that various changes and modifications may be made therein without departing from the spirit and scope of the invention. For example, the target thickness may be varied even for a given $e^-$beam energy. This affords an additional opportunity to tailor the x-ray beam with regard to average energy and energy profile to specific clinical needs, in particular radio treatment in the head/neck area.

I claim:

1. A target assembly for an electron linear accelerator, comprising:

(a) a target means for converting an electron beam into an x-ray beam, said target means including a chamber which has a variable thickness, wherein said chamber is defined by two parallel plates and a spacer means connecting both plates, and wherein said chamber contains a target medium;

(b) an electron beam means for exposing said chamber to said electron beam; and (c) adjustment means for setting said variable thickness to a predetermined value.

2. A target assembly according to claim 1, wherein the variable thickness of said chamber is set to a value of at least $0.15\times d_O$ and at most $0.25\times d_O$, with $d_O$ being the penetration depth of said electron beam.

3. A target assembly according to claim 1, wherein said spacer means comprises a bellows connecting both plates, and said medium is in liquid form at least when said target means is exposed to said electron beam.

4. A target assembly according to claim 3, wherein said medium is mercury.

5. A target assembly according to claim 3, wherein said medium is lead.

6. A target assembly according to claim 3, wherein said medium is Wood's alloy.

7. A target assembly according to claim 3, wherein said chamber communicates with a compensating tank.

8. A target assembly according to claim 3, further comprising cooling means for extracting said medium from said chamber, cooling the extracted medium and directing the cooled medium back into the chamber.

9. A target assembly according to claim 8, wherein said chamber comprises an inlet and an outlet and said cooling means include a pipe both ends thereof being connected to said input and said output respectively, and a pump inserted into said pipe for circulating said medium.

10. A target assembly according to claim 8, wherein said chamber comprises an inlet and an outlet and said cooling means include a pipe, said pipe being part of a heat exchanger and having its both ends connected to said input and said output respectively.

11. A target assembly according to claim 10, wherein said heat exchanger further comprises a helix wound around said pipe and filled with a cooling liquid.

12. A target assembly according to claim 3, wherein said adjustment means comprise control means for controlling the distance between both plates.

13. A target assembly according to claim 12, wherein said control means comprise at least one motor driven spindle passing through both plates outside said chamber.

* * * * *